US005361900A

United States Patent [19]

Stringer et al.

[11] Patent Number: 5,361,900

[45] Date of Patent: Nov. 8, 1994

[54] COMPRESSOR SHIPPING CARTON

[75] Inventors: Hugh C. Stringer; Phillip S. Leonard, both of Bristol, Va.

[73] Assignee: Bristol Compressors, Bristol, Va.

[21] Appl. No.: 59,930

[22] Filed: May 10, 1993

[51] Int. Cl.[5] ..... B65D 85/68

[52] U.S. Cl. ..... 206/319; 206/485; 206/486; 206/589; 206/593; 229/120.36; 217/31

[58] Field of Search ..... 206/319, 386, 485, 488, 206/486, 490, 588, 589, 592, 593; 229/120.36; 217/30, 31

[56] References Cited

U.S. PATENT DOCUMENTS

| | | | |
|---|---|---|---|
| 2,925,209 | 2/1960 | Wasyluka | 217/31 |
| 3,008,572 | 11/1961 | Wagner | 206/600 |
| 3,494,534 | 2/1970 | McFarland et al. | 206/592 |
| 3,820,679 | 6/1974 | Schweitzer | 229/120.36 |
| 4,067,492 | 1/1978 | Gargan | 229/120.36 |
| 4,875,580 | 10/1989 | Stringer et al. | 206/319 |

FOREIGN PATENT DOCUMENTS

| | | | |
|---|---|---|---|
| 685567 | 9/1979 | U.S.S.R. | 206/589 |

*Primary Examiner*—David T. Fidei

[57] ABSTRACT

A compressor shipping carton having a sheet-like base pad provided with a plurality of depressions or compressor feet retainers in the top surface thereof arranged in a close pattern and each adapted to snugly receive the mounting feet of a compressor for preventing lateral movement thereof, a plurality of rectangular, corrugated paperboard partitions having only side and end walls and being sufficiently wide to accommodate a single compressor and its associated retainer, and being sufficiently long to accommodate at least two compressors and their associated retainers, said partitions resting edgewise and side by side on said base pad, a plurality of rectangular, corrugated paperboard dividers each having side, top and bottom, and end walls providing a substantially closed tube of relatively narrow width and affording a degree of crushability for absorbing forces generated by tilting of the compressors, laterally aligned notches in the upper wall portions of the partitions and laterally aligned slots in the bottom and lower wall portions of the dividers, the dividers being assembled with the partitions by internesting of the notches and slots, with the dividers lying edgewise within the notches, thereby providing a plurality of transport pockets for the compressors.

12 Claims, 4 Drawing Sheets

COMPRESSOR SHIPPING CARTON

FIELD OF THE INVENTION

The present invention concerns shipping cartons or cushioning assemblies of the type typically constructed of cardboard, corrugated paperboard or the like, and which must meet economically imposed requirements of being lightweight and low cost while also providing the necessary strength and impact resistance for protecting the product during rough transportation, storage and handling activity.

BACKGROUND OF THE INVENTION

The use of such cartons for shipping, storing or handling refrigeration or air conditioning compressors, i.e., lift truck stacking and moving, and the like present special problems in that such compressors are very heavy for their size and tend to tip into one another during the handling or transportation and thereby become damaged.

DISCUSSION OF PRIOR ART

Many types of carton structures are shown in the patent literature for storing or transporting an array of articles, and representative of these patents which use various types of dividers or the like are as follows: U.S. Pat. Nos. 937,805; 1,125,829; 2,989,222; 3,038,625; 3,967,772; 4,223,827; 4,272,008; 4,335,842; 4,361,264. None of the structures of this prior art are designed to handle such items as heavy compressors or the like wherein forces such as applied by fork lift trucks are encountered.

Objects, therefore, of the present invention are: to provide a compressor transport carton which accommodates group packed compressors and which markedly improves cushioning and resistance to tipping of the compressors into each other; and to provide such carton with structure which is lightweight, and economical to manufacture, assemble and use.

SUMMARY OF THE INVENTION

These and other objects hereinafter becoming evident have been attained in accordance with the present invention which is defined as a compressor shipping carton comprising:

(1) sheet-like base pad having a plurality of depressions or compressor mounting feet retainers in the top surface thereof arranged in a close pattern and each adapted to snugly receive the mounting feet of a compressor for preventing lateral movement thereof;

(2) at least two partition means each having a pair of side walls and a pair of end walls interconnected to provide an elongated, substantially rectangular shell open at the bottom and top as defined by bottom and top edges of said walls and having a longitudinal axis, said plurality of partition means being mounted side-by-side on said base pad with said bottom edges thereof in contact with said base pad, the upper portions of the side walls of each said shell being provided with a plurality of downwardly oriented, longitudinally spaced notches forming notch pairs each having a lateral axis oriented substantially normal to said longitudinal axis, the lateral axes of the notch pairs of each shell being in substantial alignment with the lateral axes of the notch pairs of all other shells to provide a plurality of longitudinally spaced connector valleys extending laterally across all of said partition means; and (3) at least two divider means each having side walls, top and bottom walls and end walls forming a relatively thin, rectangular, hollow tube having a longitudinal axis, a plurality of upwardly oriented slots in each said tube longitudinally spaced therealong and extending through the bottom and lower portions of each side wall thereof and each having a lateral axis oriented substantially normal to the longitudinal axis of said divider means, the slots in each tube being adapted for substantial alignment with the slots in each other tube to provide a plurality of locator troughs extending laterally across all of said divider means, said tubes being interconnected with said shells with said valleys and troughs in nested array wherein each slot receives the lower portion of a side wall of at least one shell, which lower portion is in substantial vertical alignment with the notch in said side wall, thereby providing a multiplicity of transport pockets for containment of said compressors.

In certain preferred embodiments:

(a) the ends of the tubes are provided by in-folding flaps;

(b) the tubes are comprised of single ply corrugated paperboard having a height to width ratio of from about 4/1 to about 6/1; and (c) the depressions in the base pad are provided in a rectangular array with the axis of each depression oriented at an angle with respect to the axis of the array to allow positioning of the compressor feet at an angle with respect to force applied by a lift truck or the like against a pallet supporting the present carton structure and compressors contained thereby.

BRIEF DESCRIPTION OF THE DRAWINGS

Further object and advantages of the present invention will become evident from the following drawings and description of preferred embodiments, wherein.

Figure 1:
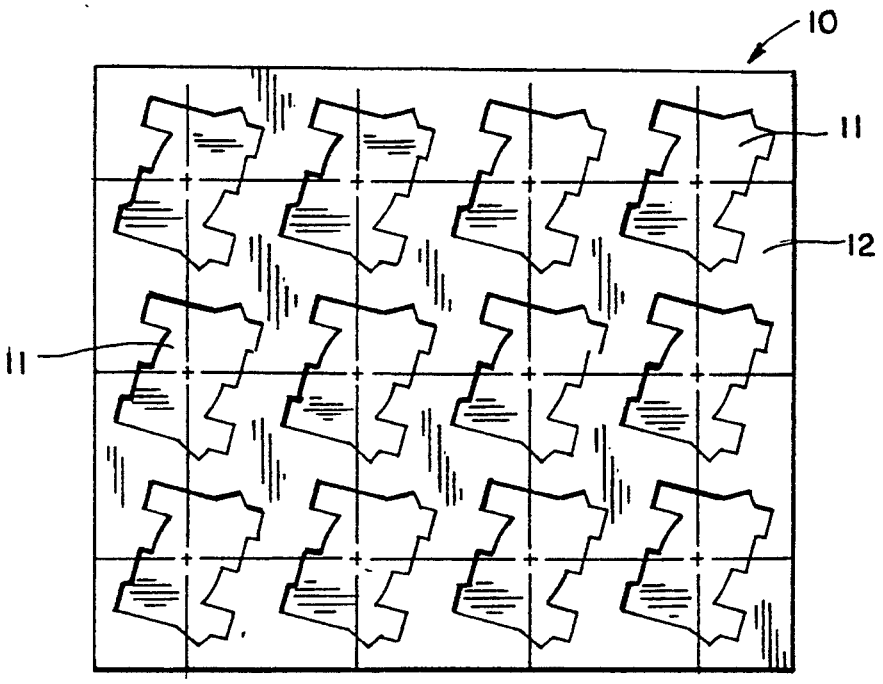
FIG. 1 is plan view of the base pad showing the depressions into which the compressor feet fit.

With reference to the claims hereof and the drawings, the present compressor shipping carton is defined in its broad sense as comprising:

(1) a sheet-like base pad 10 having a plurality of depressions 11 in the top surface 12 thereof arranged in a close pattern and each adapted to snugly receive the mounting feet 13 and 14 of a compressor 15 for preventing lateral movement thereof;

(2) at least two partition means 16 and 17 each having a pair of side walls 18 and 19 and a pair of end walls 20 and 21 interconnected to provide an elongated, substantially rectangular shell open at the bottom 22 and top 23 as defined by bottom and top edges 24 and 25 of said walls and having a longitudinal axis or plane 26, said plurality of partition means being mounted side-by-side on said base pad with said bottom edges thereof in contact with said base pad, the upper portions 27 of the side walls of each said shell being provided with a plurality of downwardly oriented, longitudinally spaced notches 28 forming notch pairs each having a lateral axis or plane 29 oriented substantially normal to said longitudinal axis and passing through the midpoint 45 of said notch pairs, the lateral axes of the notch pairs of each shell being in substantial alignment with the lateral axes of the notch pairs of all other shells to provide a plurality of longitudinally spaced connector valleys 30 encompassing said plane 36 and extending laterally across all of said partition means; and (3) at least two divider means 31 each having opposing side walls 32, top 33 and bottom walls 34 and end walls 35 and 36 forming a relatively thin, rectangular, hollow tube having a longitudinal axis or plane 37, a plurality of upwardly oriented slots 38 in each said tube longitudinally spaced therealong and extending through the bottom wall 34 and lower portions 40 of each side wall thereof and each having a lateral axis or plane 41 oriented substantially normal to the longitudinal axis 37 of said divider means, the slots in each tube being adapted for substantial alignment with the slots in each other tube to provide a plurality of locator troughs 42 extending laterally across all of said divider means and encompassing said planes 37, said tubes being interconnected with said shells with said alleys and troughs in nested array wherein each slot receives the lower portion 43 of a side wall of at least one shell, which lower portion is in substantial vertical alignment with the notch in said side wall, thereby providing a multiplicity of transport pockets 44 for containment of said compressors.

Figure 2:
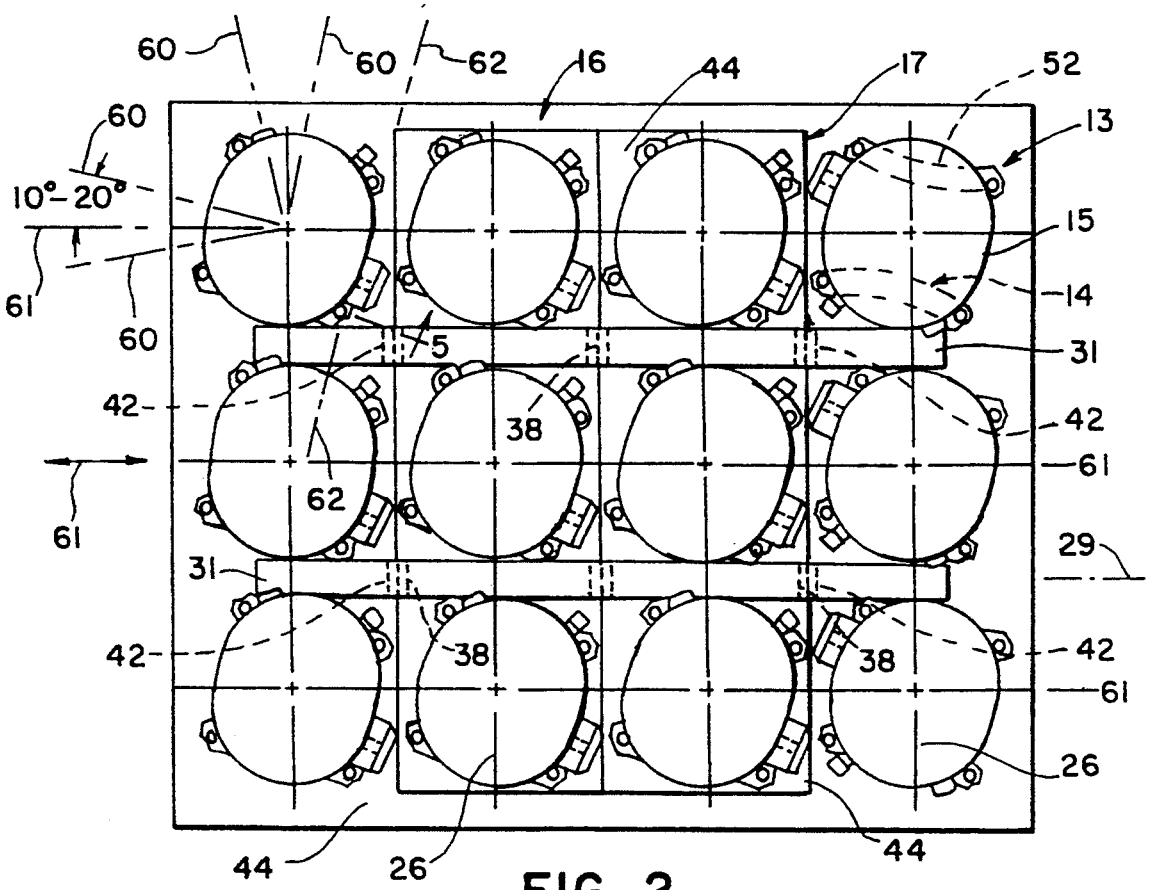
FIG. 2 is a plan view as in FIG. 1 showing the compressors with their feet nested in the pad depressions.
Figure 3:
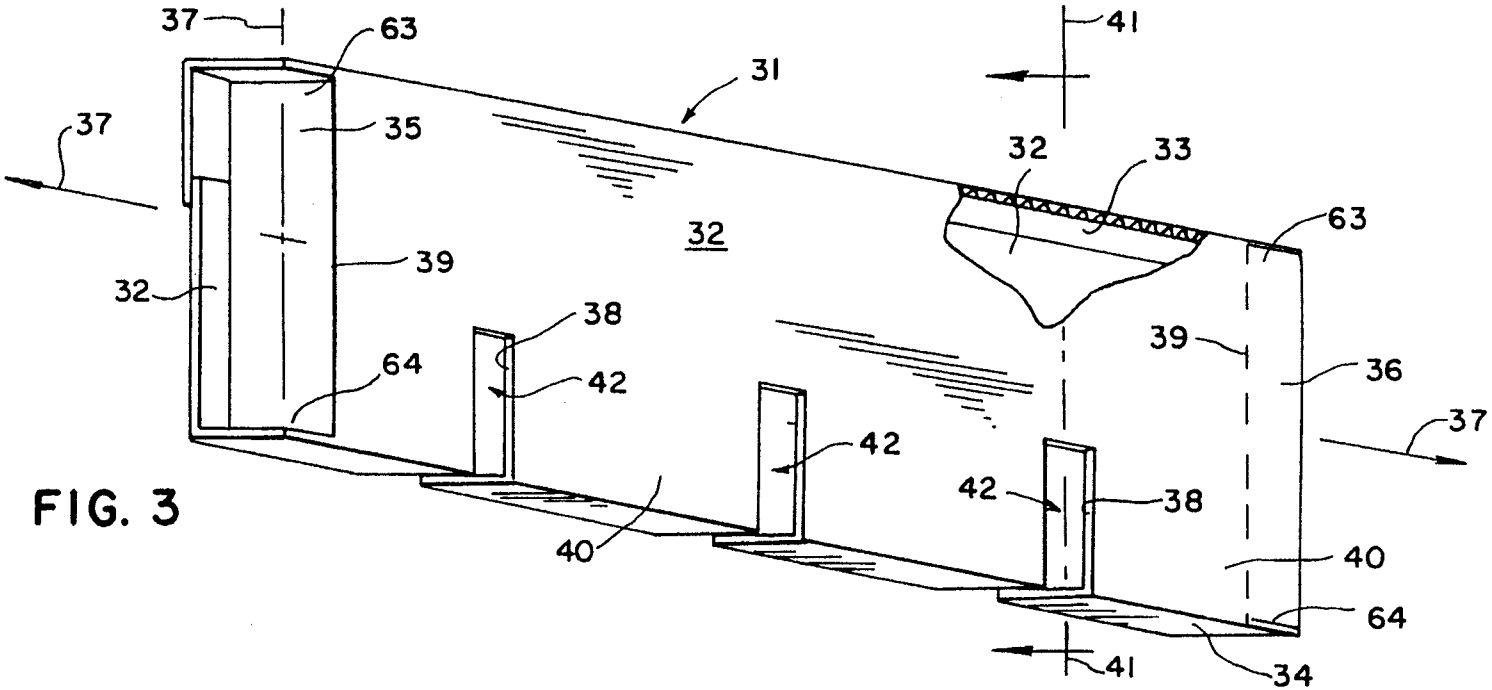
FIG. 3 is an isometric view of a divider means of the present invention.
Figure 4:
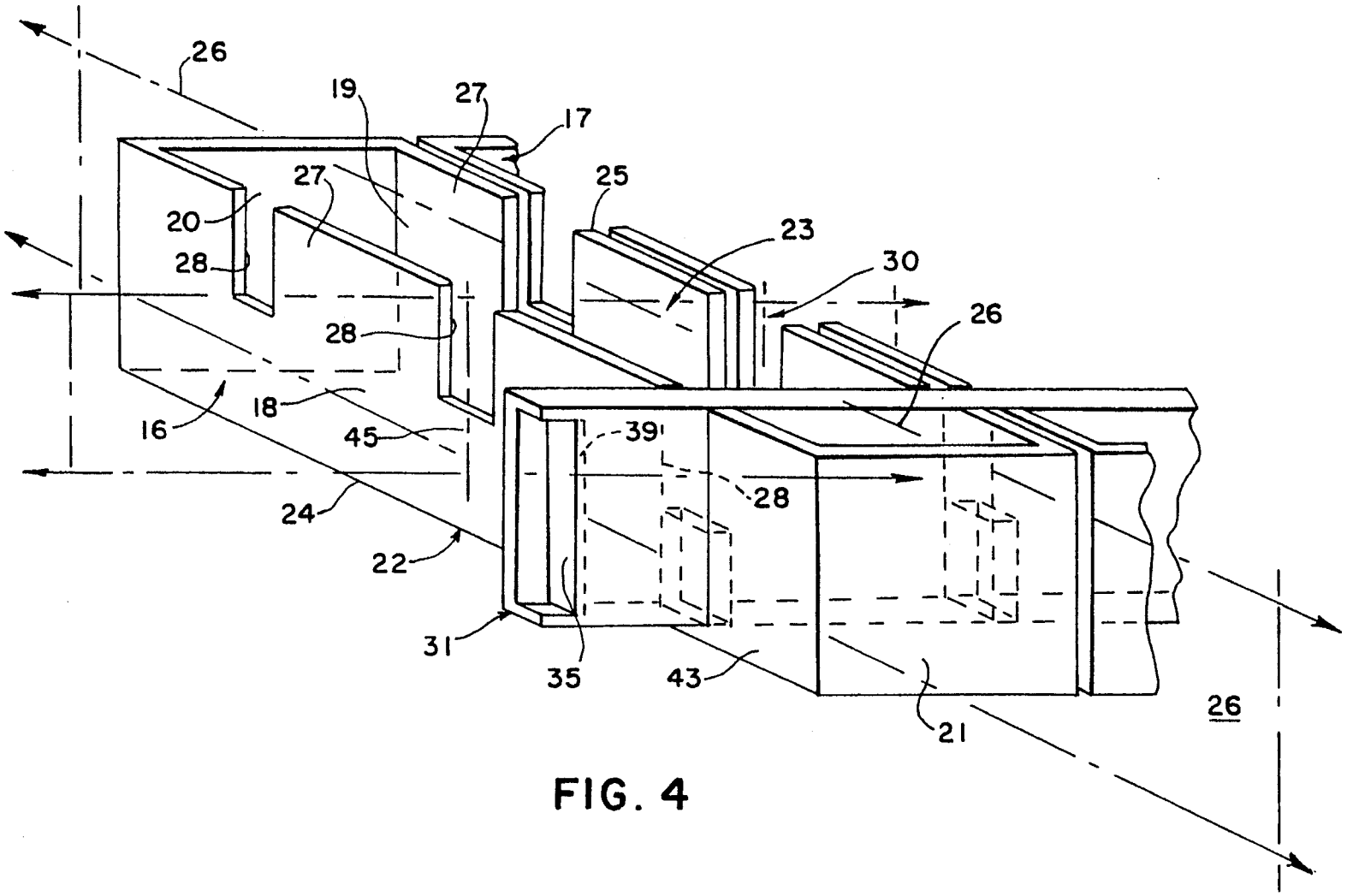
FIG. 4 is an isometric view of the divider means of FIG. 3 with its slots nested within the notches of two side-by-side partition means, with the wall and end thicknesses, and the spacing between the two partition means enlarged for clarity.

It is particularly noted that the present carton structure of the partition means and the divider means can be employed in an upside down orientation from that shown in FIGS. 3 and 4 of the drawings, i.e., as shown in FIG. 2, the dividers can be on the bottom so to speak such that the slots 38 therein are facing upwardly. Therefore, the reference in the specification and claims as to the upper and lower portions of the side walls, or the bottom or top of the dividers, through which the notches or slots are formed, are for purposes of structure clarification and are not to be limiting as to whether these structures are being used in the orientation of FIG. 2 or FIG. 4.

Figure 5:
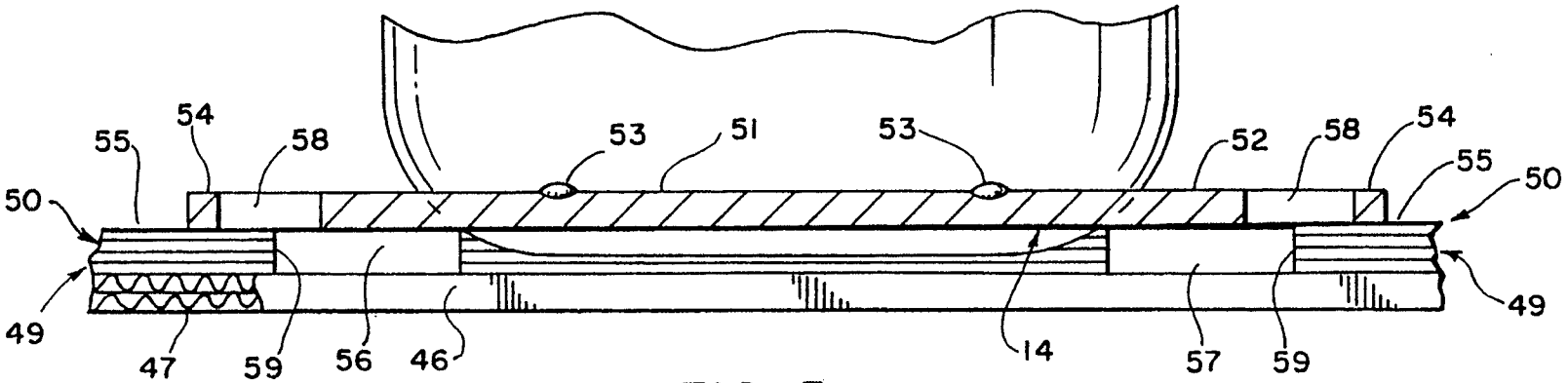
FIG. 5 is a cross sectional view of a preferred base pad construction taken along lines 5—5 of FIG. 2 in the direction of the arrows, with the various relative dimensions being only approximate.

The base pad as shown in cross-sectional detail in FIG. 5 preferably comprises a double ply corrugated paperboard floor 46, a portion 47 of which is shown cross-hatched, to the top surface 48 of which is adhesively secured two double ply layers 49 and 50 which are adhesively affixed to each other. Preferably these layers are oriented with the corrugations running transversely to the corrugations of floor 46.

The compressor mounting feet 13 and 14 preferably are of inverted channel iron shape and each extending across a vertically recessed portion 51 of the underside of the compressor with its web 52 welded thereto as at 53. The webs 52 of the channels preferably extend beyond the channel sides such that the web 54 rests on the top surface 55 of layer 50. In the embodiment shown, the inner side of channel 14 consist only of two end pieces 56 and 57 which rest on floor 46. Apertures 58 are provided in the mounting feet for receiving mounting grommets or the like in known manner. The shoulders 59 provided by layers 49 and 50 prevent direct lateral movement of the compressor feet.

The partition means or shells 16 and 17, and the divider means 31 are preferably of single ply corrugated paperboard, and the notches and slots respectively therein are liberally dimensioned to make the nesting assembly of the shells and dividers relatively easy.

Figure 6:
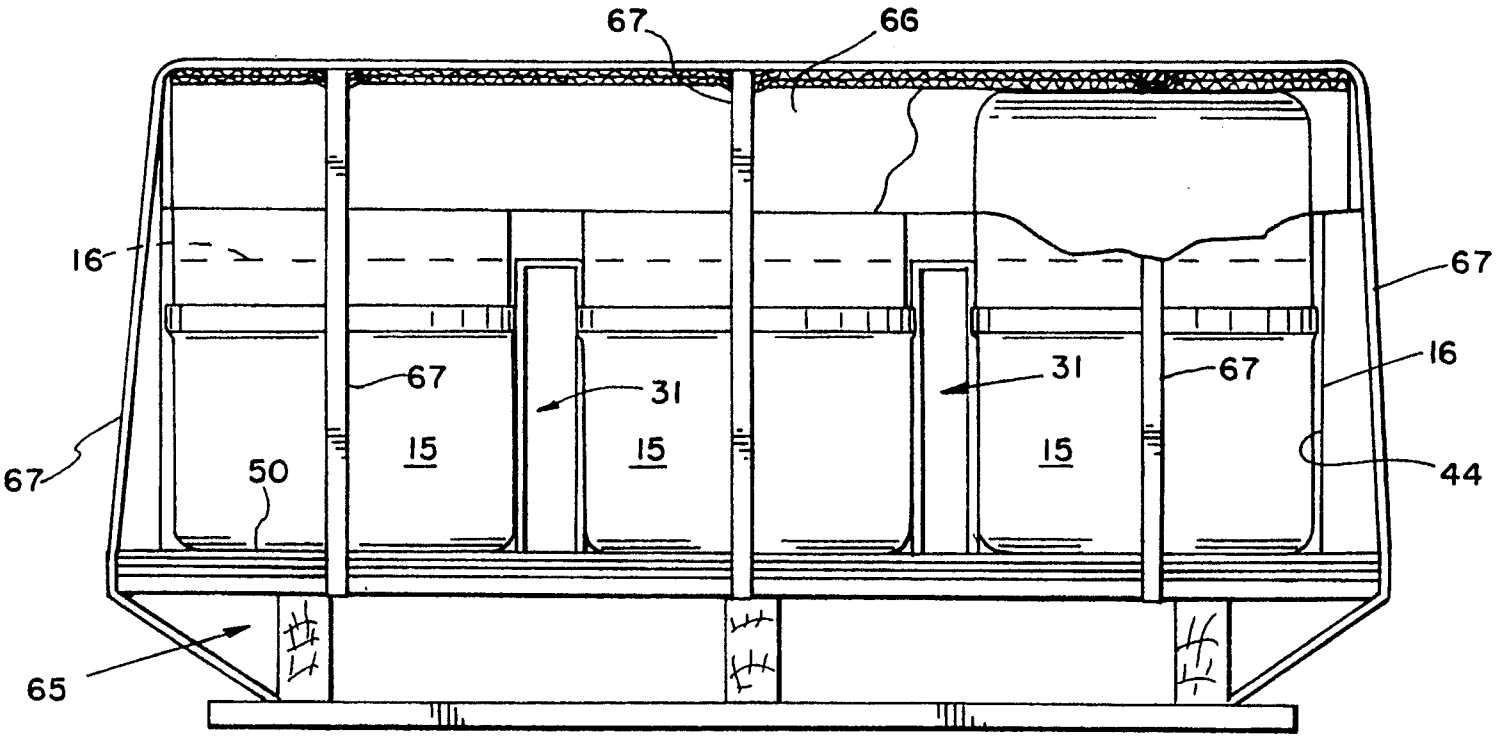
FIG. 6 is a view partially in section, of a pack of compressors packaged in a carton and secured by straps to a fork lift pallet in accordance with the present invention.

The partition shells and dividers are dimensioned as shown in FIG. 6 to contact the compressors at a point at least about one half their height above floor 46. The corrugated board used for the dividers 31 is sufficiently heavy to resist crushing by compressors subjected to substantial tipping forces. In this regard, a highly preferred feature of the present invention is the angulation of the compressor and depression axis 60 with respect to the several axes of the depression array, i.e., the normal direction 61 of fork lift operation, which angulation orients the compressor feet along a tilt axis 62, i.e., an angle, for example, of from about 5°–30°, preferably about 10° to about 20° as shown in FIG. 2. This angulation is not so severe as to significantly diminish the storage capacity of the carton and gives the advantages of directing most of the compressors to tilt into the shock absorbing dividers 31 in response to a force in either direction along lines 61 rather than into the weaker partition means. It is particularly noted that the enhanced resistance to tilting afforded by this angulation is greatly magnified by dissipation of the tilting force throughout the compressor and carton array along the angular axis 60 which, of course, works for any of the directions denoted by the numeral 60 in FIG. 2.

The ends of divider means 31 are preferably constructed as shown in FIGS. 3 and 4 as comprising end flaps 35 and 36, end 35 being shown as in-folded along an indented or serrated fold line 39. This in-folding is made possible by cutting back, i.e., separating the end portions 63 and 64 of the side walls 32 form the top and bottom walls 33, 34 a sufficient distance to allow the flaps to be pushed inwardly against the opposing side wall with sufficient frictional contact to retain the flaps in their inward position. Such construction allows the divider to be stored in a flat condition with the sides lying against each other for minimizing space requirements, and still providing a means whereby the divider can be readily expanded into its rectangular shape and then fixed into a sturdy, beam-like structure simply by infolding the flaps 35 and 36 into frictional contact with the side walls. As shown in FIG. 4, the dividers may not necessarily extend all the way down to the base pad, and in this regard, it is noted that the main resistance to tilting of the compressors derives from the upper portions of the dividers. The number of divider means and partition means may, of course, be varied as desired, as also the strengths of the materials of construction.

The present carton construction is particularly suited for use in connection with a fork lift pallet 65 as shown in FIG. 6 wherein the compressors are positioned in the transport pockets 44 and held in position on the pallet by a corrugated paperboard cap 66 and tie straps 67.

The invention has been described in detail with particular reference to preferred embodiments thereof, but it will be understood that variations and modifications will be effected within the spirit and scope of the invention.

We claim:

1. A shipping carton for compressors having at least two mounting feet, said carton comprising:

(a) a substantially flat, corrugated paperboard base pad having a plurality of depressions in the top surface thereof arranged in a close pattern and each adapted to snugly receive the mounting feet of a compressor for preventing lateral movement thereof;

(b) at least two partition structures each having a pair of side walls and a pair of end walls interconnected to provide an elongated, substantially rectangular shell open at the bottom and top as defined by bottom and top edges of said walls and having a longitudinal axis, said plurality of partition structures being mounted side-by-side on said base pad with said bottom edges thereof in contact with said base pad, the upper portions of the side walls of each said shell being provided with a plurality of downwardly oriented, longitudinally spaced notches forming notch pairs each having a lateral axis oriented substantially normal to said longitudinal axis, the lateral axis of each notch pair of each shell being in substantial alignment with a lateral axis of a notch pair of each other shell to provide a plurality of longitudinally spaced connector valleys extending laterally across all of said partition structures; and (c) at least two dividers each having side walls, top and bottom walls and end walls forming a relatively thin, rectangular, hollow tube having a longitudinal axis, a plurality of upwardly oriented slots in each said tube longitudinally spaced therealong and extending through the bottom and lower portions of each side wall thereof and each having a lateral axis oriented substantially normal to the longitudinal axis of said dividers, each slot in each said tube being adapted for substantial alignment with a slot in each other tube to provide a plurality of locator troughs extending laterally across all of said dividers, said tubes being interconnected with said shells with said valleys and troughs in nested array wherein each slot receives the lower portion of a side wall of at least one shell, which lower portion is in substantial vertical alignment with the notch in said side wall, thereby providing a multiplicity of transport pockets for containment of said compressors.

2. The carton of claim 1 wherein the ends of the tubes are provided by in-folding flaps.

3. The carton of claim 1 wherein the tubes are comprised of single ply corrugated paperboard having a height to width ratio of from about 4/1 to about 6/1.

4. The carton of claim 1 wherein the depressions in the base pad are provided in a rectangular array with the axis of each depression oriented at an angle with respect to the axis of the array to allow positioning of the compressor feet at an angle with respect to force applied by a lift truck or the like against a pallet supporting the present carton structure and compressors contained thereby.

5. The carton of claim 4 wherein said angle is between about 10° and 20°.

6. The carton of claim 1 wherein the ends of the tubes are provided by in-folding flaps and are comprised of single ply corrugated paperboard having a height to width ratio of from about 4/1 to about 6/1, and the depressions in the base pad are provided in a rectangular array with the axis of each depression oriented at an angle with respect to the axis of the array to allow positioning of the compressor feet at an angle with respect to force applied by a lifting device against a pallet supporting the present carton structure and the compressors contained thereby, said angle between about 10° and 20°.

7. A shipping carton for compressors having at least two mounting feet, said carton having a substantially flat, corrugated paperboard base pad provided with a plurality of compressor mounting feet retainer depressions in the top surface thereof arranged in a close pattern and each adapted to snugly receive the mounting feet of a compressor for preventing lateral movement thereof, a plurality of rectangular, corrugated paperboard partitions having only side and end walls and being sufficiently wide to accommodate a single compressor and its associated retainer, and being sufficiently long to accommodate at least two compressors and to encompass the area of the retainer depressions in which their mounting feet are to be positioned, said partitions resting edgewise and side by side on said base pad, a plurality of rectangular, corrugated paperboard dividers each having side, top, bottom and end walls providing a substantially closed tube of relatively narrow width and affording a degree of crushability for absorbing forces generated by tilting of the compressors, laterally aligned notches in the upper wall portions of the partitions and laterally aligned slots in the bottom and lower wall portions of the dividers, the dividers being assembled with the partitions by internesting of the notches and slots, with the dividers lying edgewise within the notches, thereby providing a plurality of transport pockets for the compressors.

8. The carton of claim 7 wherein the ends of the tubes are provided by in-folding flaps.

9. The carton of claim 7 wherein the tubes are comprised of single ply corrugated paperboard having a height to width ratio of from about 4/1 to about 6/1.

10. The carton of claim 7 wherein the depressions in the base pad are provided in a rectangular array with the axis of each depression oriented at an angle with respect to the axis of the array to allow positioning of the compressor feet at an angle with respect to force applied by a lifting device against a pallet supporting the present carton structure and compressors contained thereby.

11. The carton of claim 10 wherein said angle is between about 10° and 20°.

12. The carton of claim 7 wherein the ends of the tubes are provided by in-folding flaps and are comprised of single ply corrugated paperboard having a height to width ratio of from about 4/1 to about 6/1, and the depressions in the base pad are provided in a rectangular array with the axis of each depression oriented at an angle with respect to the axis of the array to allow positioning of the compressor feet at an angle with respect to force applied by a lift truck or the like against a pallet supporting the present carton structure and the compressors contained thereby, said angle between about 10° and 20°.

* * * * *